US007392961B2

(12) United States Patent
McNeil et al.

(10) Patent No.: US 7,392,961 B2
(45) **Date of Patent: *Jul. 1, 2008**

(54) HYBRID WINDER

(75) Inventors: Kevin Benson McNeil, Loveland, OH (US); Michael James Gworek, Mason, OH (US); Jeffrey Moss Vaughn, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 337 days.

This patent is subject to a terminal disclaimer.

(21) Appl. No.: 11/216,901

(22) Filed: Aug. 31, 2005

(65) Prior Publication Data

US 2007/0045462 A1 Mar. 1, 2007

(51) Int. Cl.
*B65H 18/14* (2006.01)

(52) U.S. Cl. ..... 242/541.3; 242/535.4; 242/554.3; 242/555.5; 242/559.2

(58) Field of Classification Search ..... 242/541.7, 242/541.6, 541.5, 521, 526, 522, 526.1, 533.4, 242/533.6, 533.5, 541.3, 541.4, 535.4, 554.3, 242/555.5, 559.2
See application file for complete search history.

(56) References Cited

U.S. PATENT DOCUMENTS

| | | | | |
|---|---|---|---|---|
| 1,040,188 | A | 10/1912 | Gray | |
| 1,699,928 | A * | 1/1929 | Stone | 242/555.6 |
| 1,787,463 | A * | 1/1931 | Wood | 242/555.6 |
| 2,039,463 | A * | 5/1936 | Tornberg | 242/555.6 |
| 2,070,317 | A * | 2/1937 | Recsen | 242/555.6 |
| 2,769,600 | A | 11/1956 | Kwitek et al. | |
| 3,630,462 | A | 12/1971 | Nordgren | |
| 3,697,010 | A | 10/1972 | Nystrand | |
| 3,791,602 | A | 2/1974 | Isakson | |
| 3,885,749 | A * | 5/1975 | Skacel | 242/420 |
| 4,422,588 | A | 12/1983 | Nowisch | |
| 4,431,140 | A | 2/1984 | Tetro | |
| 4,541,583 | A | 9/1985 | Forman et al. | |
| 4,588,138 | A | 5/1986 | Spencer | |
| 4,687,153 | A | 8/1987 | McNeil | |
| 4,723,724 | A | 2/1988 | Bradley | |
| 4,798,350 | A | 1/1989 | Jorgensen et al. | |
| 4,811,915 | A | 3/1989 | Smith | |
| 4,828,195 | A | 5/1989 | Hertel et al. | |
| 4,856,725 | A | 8/1989 | Bradley | |
| 4,909,452 | A | 3/1990 | Hertel et al. | |

(Continued)

FOREIGN PATENT DOCUMENTS

| | | |
|---|---|---|
| EP | 0 291 767 B1 | 11/1991 |

(Continued)

*Primary Examiner*—Peter M. Cuomo
*Assistant Examiner*—William E Dondero
(74) *Attorney, Agent, or Firm*—Peter D. Meyer; Betty J. Zea; David M. Weirich

(57) ABSTRACT

A winder for winding continuous webs or interleaved web segments into rolls is disclosed. The winder comprises first and second rollers, each having a generally mutually parallel longitudinal axis. The winder also has a continuous belt. The continuous web is disposed upon at least a portion of the continuous belt. A rotatably driven winding spindle is adapted to receive the continuous web or interleaved web segments when the spindle is proximate to the continuous web or interleaved web segments disposed upon the continuous belt.

20 Claims, 5 Drawing Sheets

U.S. PATENT DOCUMENTS 4,919,351 A 4/1990 McNeil
4,955,554 A 9/1990 LeBoeuf et al.
4,962,897 A 10/1990 Bradley
4,993,652 A 2/1991 Moeller
5,104,055 A 4/1992 Buxton
5,104,155 A 4/1992 Kirkwood
5,137,225 A 8/1992 Biagiotti
5,190,232 A 3/1993 Brandon et al.
5,226,611 A 7/1993 Butterworth et al.
5,267,703 A 12/1993 Biagiotti
5,285,979 A 2/1994 Francesco
5,312,059 A 5/1994 Membrino
5,335,869 A 8/1994 Yamaguchi et al.
5,368,252 A 11/1994 Biagiotti
5,370,335 A 12/1994 Vigneau
5,402,960 A 4/1995 Oliver et al.
5,431,357 A 7/1995 Rüegg
5,497,959 A 3/1996 Johnson et al.
5,505,405 A 4/1996 Vigneau
5,538,199 A 7/1996 Biagiotti
5,542,622 A 8/1996 Biagiotti
5,565,033 A 10/1996 Gaynes et al.
5,603,467 A 2/1997 Perini et al.
5,660,349 A 8/1997 Miller et al.
5,660,350 A 8/1997 Byrne et al.
5,667,162 A 9/1997 McNeil et al.
5,690,297 A 11/1997 McNeil et al.
5,725,176 A 3/1998 Vigneau
5,732,901 A 3/1998 McNeil et al.
5,769,352 A 6/1998 Biagiotti
5,772,149 A 6/1998 Butterworth
5,779,180 A 7/1998 Smedt et al.
5,810,282 A 9/1998 McNeil et al.
5,839,680 A 11/1998 Biagiotti
5,845,867 A 12/1998 Hould et al.
5,899,404 A 5/1999 McNeil et al.
5,901,918 A * 5/1999 Klerelid et al. ..... 242/534
5,909,856 A 6/1999 Myer et al.
5,913,490 A 6/1999 McNeil et al.
5,944,273 A * 8/1999 Lin et al. ..... 242/160.4
5,979,818 A 11/1999 Perini et al.
6,000,657 A 12/1999 Butterworth
6,056,229 A 5/2000 Blume et al.
6,142,407 A 11/2000 McNeil et al.
6,308,909 B1 * 10/2001 McNeil et al. ..... 242/527.4
6,354,530 B1 3/2002 Byrne et al.
6,488,226 B2 12/2002 McNeil et al.
6,536,702 B1 * 3/2003 Vargo et al. ..... 242/530.2
6,565,033 B1 5/2003 Biagiotti
6,595,458 B1 7/2003 Biagiotti
6,595,459 B2 7/2003 Hanson
6,648,266 B1 11/2003 Biagiotti et al.
6,659,387 B2 12/2003 Biagioni et al.
6,698,681 B1 * 3/2004 Guy et al. ..... 242/534
6,715,709 B2 4/2004 Stephens et al.
6,729,572 B2 5/2004 Baggot et al.
6,752,344 B1 6/2004 Biagiotti
6,752,345 B2 6/2004 Betti et al.
6,834,824 B1 12/2004 Smith
6,866,220 B2 3/2005 Sosalla et al.
2002/0130212 A1 9/2002 Yamasaki
2003/0226928 A1 12/2003 McNeil et al.

FOREIGN PATENT DOCUMENTS

EP 0 514 226 A1 11/1992
EP 1 375 402 A1 1/2004
WO WO 99/02439 1/1999
WO WO 99/42393 8/1999
WO WO 01/16008 A1 3/2001
WO WO 02/055420 A1 3/2002
WO WO 03/074398 A2 9/2003

* cited by examiner

HYBRID WINDER

FIELD OF THE INVENTION

The present invention relates to winding and rewinding devices, particularly to those rewind devices suitable for use in converting large rolls of wound web material into a finally wound product suitable for use by a consumer.

BACKGROUND OF THE INVENTION

Web winders are typically used to form large rolls of wound web material, such as paper and polymeric film materials, known as parent rolls. From the parent rolls, rewinders are employed in order to wind the web material into a rolled product. The rolled product is then cut at designated lengths into the final product. Final products typically created by these machines and processes are toilet tissue rolls, paper toweling rolls, paper rolls, polymeric films, and the like.

There are essentially two types of techniques known in the art for performing the step of rewinding, that is, winding a web material from a parent roll into a rolled product. The first technique used in winding a web material to form a rolled product is known as surface winding. In surface winding, the web material is wound onto the core via contact with belts and/or rotating rolls. A nip is typically formed between these two or more co-acting belt, or roller, systems. The belts or rollers of such systems typically travel in opposite directions at different speeds. The reason for having different speeds lies in the fact that the core that is being driven by the opposed belts or rollers will advance in the direction of the faster moving belt or roller. Usually these belts or rollers are divergent so that the rolled product that is being built upon the core will have enough space to grow in diameter, and will be able to maintain contact with the two diverging belts or rollers. Exemplary surface winders are disclosed in U.S. Pat. Nos. 3,630,462; 3,791,602; 4,541,583; 4,723,724; 4,828,195; 4,856,725; 4,909,452; 4,962,897; 5,104,055; 5,137,225; 5,226,611; 5,267,703; 5,285,979; 5,312,059; 5,368,252; 5,370,335; 5,402,960; 5,431,357; 5,505,405; 5,538,199; 5,542,622; 5,603,467; 5,769,352; 5,772,149; 5,779,180; 5,839,680; 5,845,867; 5,909,856; 5,979,818; 6,000,657; 6,056,229; 6,565,033; 6,595,458; 6,595,459; 6,648,266; 6,659,387; 6,698,681; 6,715,709; 6,729,572; 6,752,344; 6,752,345; 6,866,220; International Publication Nos. 01/16008 A1; 02/055420 A1; 03/074398 A2; 99/02439; 99/42393; and EPO Patent Application No. 0514226 A1. However such winders can have drawbacks. First, a typical surface winder provides significant contact between the web material and the winding surfaces during winding. This contact during winding can effectively translate winding torque through the web material leading to crushing the embossments disposed upon an embossed material, smudging images disposed upon the web material, and the like. Also, surface winders are known to exhibit winding log instability during the winding of low-density products.

The second technique used to wind a web material to form a rolled product is known as center winding. In center winding, a core is rotated in order to wind a web material into a roll around the core. Typically, this core is mounted on a mandrel that rotates at high speeds at the beginning of a winding cycle and then slows down as the size of the rolled product being wound upon the core increases in diameter. Center winders work well when the web material that is being wound has a printed, textured, or slippery surface. Also, center winders are very useful in producing softer rolled products. Exemplary center winders are discussed in U.S. Pat. Nos. 1,040,188; 2,769,600; 3,697,010; 4,588,138; 5,497,959; 5,660,349; 5,725,176; and U.S. Patent Application Publication No. 2002/0130212 A1. However, center winders have drawbacks that are known to those of skill in the art. Known drawbacks include the need to provide a harder 'pull' when rolling high-density and low-density web materials into a high-density roll. The resulting tension can provide for a Poisson lateral contraction of the web material, resulting in a non-uniformly wound product. Additionally, the application of tension to a perforated web material can cause the web material to rupture at a perforation during processing. This can cause a processing line to shut down.

It is clear that the prior art lacks a winder or rewinder capable of performing both center winding and surface winding in order to take advantage of the positive attributes that both processes enjoy. For example, it would be desirable to provide a winder that is capable of allowing a broader range of finished product roll densities. As will be appreciated by one of skill in the art, this capability, when coupled with known capabilities for imparting perforations at desired intervals and sheet counts in increments of 1, can provide for a greatly enhanced product converting flexibility. This, in turn, can allow multiple finished product designs to be achieved using a common substrate. This can also provide substantial manufacturing expense savings by reducing changeovers on paper machines and converting lines, avoiding multiple parent roll inventories, and the like. Such a desired hybrid winding system can also provide the capability to wind thick, highly embossed web materials into preferred high density finished product rolls having low sheet tension. As will soon be appreciated by one of skill in the art, this can improve product quality by eliminating sheet elongation and embossment distortion as well as improving winding reliability by providing fewer web material feed breaks in the winding process.

SUMMARY OF THE INVENTION

The present invention provides for a winder for winding a web material into rolls. The winder comprises first and second rollers, each having a longitudinal axis associated thereto. The longitudinal axis of the first roller and the longitudinal axis of the second roller are generally parallel. Additionally, the apparatus comprises a continuous belt having a machine direction, a cross-machine direction coplanar and orthogonal thereto, and a Z-direction orthogonal to both the machine- and cross-machine directions. The continuous belt is disposed about the first and second rollers and the web material is disposed upon at least a portion of the continuous belt. The apparatus also comprises a winding spindle arranged to be rotatably driven about an axis generally parallel to the longitudinal axis of the first and second rollers. The winding spindle is adapted to receive the web material when the spindle is proximate to the web material disposed upon the continuous belt. At least one of the longitudinal axis of the first roller and the longitudinal axis of the second roller is adjustable relative to the winding spindle.

Another embodiment of the present invention provides for a winder for winding a web material into rolls, the winder comprising a belt, a winding spindle and a web separator having a peripheral speed. The belt has a machine direction, a cross-machine direction coplanar and orthogonal thereto, and a Z-direction orthogonal to both the machine direction and the cross-machine direction. The web material is disposed upon at least a portion of the belt. The winding spindle is arranged to be rotatably driven about an axis generally parallel to the cross-machine direction of the belt. The winding spindle is adapted to receive the web material when the spindle is proximate the web material disposed upon the belt. The web separator is adapted to periodically pinch the web material between the web separator and the belt when the peripheral speed of the web separator and the speed at which the web material is moving are different.

Another embodiment of the present invention also provides for a winder comprising a belt, a winding spindle operatively mounted upon a winding turret indexable about a winding turret axis through an endless series of indexed positions for winding a web material into rolls, and a web separator having a peripheral speed. The belt has a machine direction, a cross-machine direction coplanar and orthogonal thereto, and a Z-direction orthogonal to both the machine direction and the cross-machine direction. The web material is disposed upon at least a portion of the belt. The winding spindle is arranged to be rotatably driven about an axis generally parallel to the cross-machine direction of the belt. The winding spindle is adapted to receive the web material when the winding turret is indexed between a first index position and a second index position. The spindle is proximate the web material disposed upon the belt between the first and second index positions. The web separator is adapted to periodically pinch the web material between the web separator and the belt when the peripheral speed of the web separator and the speed at which the web material is moving are different.

DETAILED DESCRIPTION OF THE INVENTION

In the prior art, a winder or reel is typically known as a device that performs the very first wind of that web material, generally forming what is known as a parent roll. A rewinder, on the other hand, is generally known as a device that winds the web material from the parent roll into a roll that is essentially the finished product. For purposes of the present application, the words 'winder' and 'rewinder' are interchangeable with one another in assessing the scope of the claims.

Figure 1:
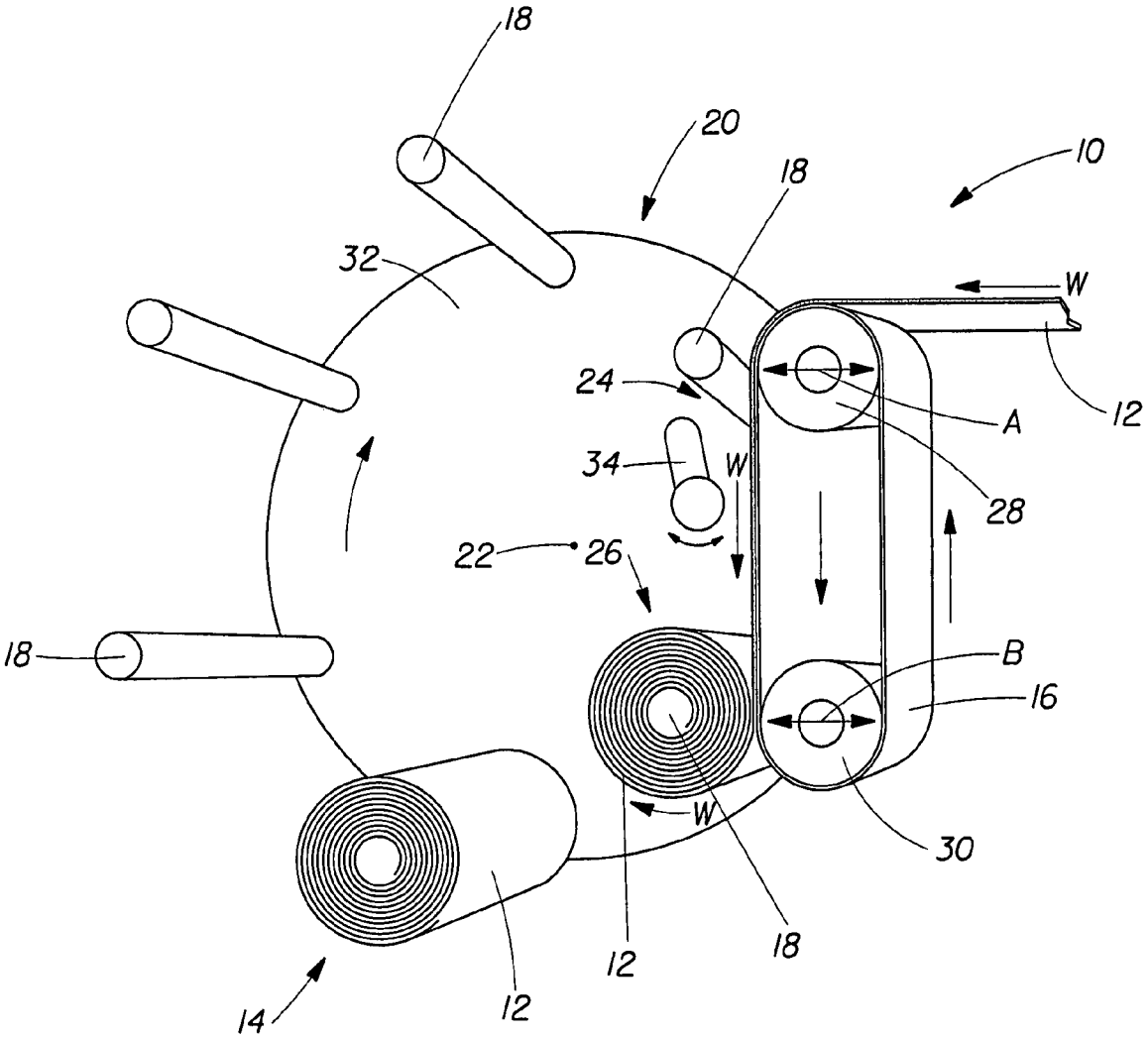
FIG. 1 is a perspective view of an exemplary embodiment of a hybrid winder in accordance with the present invention.

Referring now to the drawings, FIG. 1 shows an exemplary hybrid winder 10 in accordance with the present invention. The hybrid winder 10 is suitable for use in winding a web material 12 to produce a final wound product 14. The final wound product 14 that may be produced by the hybrid winder 10 of the present invention can be any number of types of products such as hand towels, toilet tissue, paper towels, polymeric films, trash bags, and the like. As such, web material 12 can comprise continuous web materials, discontinuous web materials comprising interleaved web segments, combinations thereof, and the like. Exemplary materials suitable for web material 12 of the present invention include, without limitation, metal foils, such as aluminum foil, wax paper or grease-proof paper, polymeric films, non-woven webs, fabrics, paper, combinations thereof, and the like. The web material 12 is shown as being transported by the hybrid winder 10 in the direction indicated by the arrow W. The hybrid winder 10 transports the web material 12 by use of a conveyor belt 16 supported by first conveyor roller 28 and second conveyor roller 30.

The web material 12 is transported by the conveyor belt 16 into winding contact with at least one winding spindle 18. In a preferred embodiment, a plurality of winding spindles 18 are disposed upon a winding turret 20 indexable about a center shaft thereby defining a winding turret axis 22. The winding turret 20 is preferably indexable, or moveable, through an endless series of indexed positions. For example, a first winding spindle 24 can be located in what may be conveniently called an initial transfer position and a second winding spindle 26 can be located in what may conveniently be called a final wind position. In any regard, the winding turret 20 is indexable from a first index position into a second index position. Thus, the first winding spindle 24 is moved from the initial transfer position into the final wind position. Such indexable movement of the first winding spindle 24 disposed upon winding turret 20 may comprise a plurality of discrete, defined positions or a continuous, non-discrete sequence of positions. However, it should be appreciated that winding spindle 18 can be brought into proximate contact with conveyor belt 16 by any means known to one of skill in the art. Exemplary, but non-limiting, turrets suitable for use with the present invention (including 'continuous motion' turrets) are disclosed in U.S. Pat. Nos. 5,660,350; 5,667,162; 5,690,297; 5,732,901; 5,810,282; 5,899,404; 5,913,490; 6,142,407; and 6,354,530. As will also be appreciated by one of skill in the art, the so-called open-loop turret systems would also be suitable for use as a support for the disposition and movement of winding spindles 18 used in accordance with the present invention. An exemplary, but non-limiting, open-loop turret system is disclosed in WO 03/074398.

If so desired by the practitioner, the conveyor belt 16 may be provided with a relieved surface. In such an embodiment, the relieved portions can be provided as a pattern disposed upon, or within, the material comprising conveyor belt 16. Such a pattern may be disposed upon, or otherwise associated with conveyor belt 16 by laser engraving, mechanical implantation, polymeric curing, or the like. In an exemplary, but non-limiting embodiment, such a pattern, relieved or otherwise, may correspond to any indicia, embossments, topography pattern, adhesive, combinations thereof, and the like, that are disposed upon, or disposed within, web material 12. It is believed that such an exemplary pattern associated with conveyor belt 16 may be registered with respect to any direction, or directions, of web material 12, particularly the machine- and/or the cross-machine directions of web material 12. Such a pattern can be associated with conveyor belt 16 and can be provided relative to any indicia, embossments, topography pattern, combinations thereof, or the like, associated with web material 12 by any means known to one skilled in the art. Such an embodiment may be useful in preserving desirable features in the web material 12 such as embossments, or may provide a desired contact force, such as for improved bonding force in areas of a two-ply, or other multiple-ply, product comprising adhesive for joining one ply to another. Similarly, the conveyor belt 16 can be provided with embossments and/or any other type of topography pattern corresponding to the portions of a multi-ply type of web material 12 that may have an adhesive or other bonding formulation or structure disposed between the plies forming web material 12. A conveyor belt 16 provided with such embossments and/or any other type of topography pattern can provide for better adhesion and/or bonding of the plies forming web material 12 by providing additional pressure to the region sought to be so bonded as would be known to one of skill in the art. It is believed that such increased bonding can be useful for the prevention of so-called 'skinned' rolls wherein the plies of a multiple-ply final rolled product 14 separate during dispensing by the consumer. This is known to those of skill in the art as an undesirable quality defect.

In a preferred embodiment of the present invention, the conveyor belt 16 is driven at a surface speed that corresponds to the speed of the incoming web material 12. A positioning device (not shown), such as linear actuators, servo motors, cams, links, and the like known by those of skill in the art as useful for such a result, are provided for control of the position of first conveyor roller 28 and second conveyor roller 30 supporting conveyor belt 16. Thus, a positioning device (not shown) associated with first conveyor roller 28 is preferably capable of moving first conveyor roller 28 along axis A. In such a preferred embodiment, axis A is generally parallel to the Z-direction relative to web material 12 as web material 12 passes proximate to a winding spindle 18. Likewise, a positioning device (not shown) associated with second conveyor roller 30 is preferably capable of adjusting the position of second conveyor roller 30 along axis B. In a preferred embodiment, axis B is preferably generally parallel to the Z-direction relative to web material 12 as web material 12 passes proximate to a winding spindle 18. It is believed that in this way, the position of first conveyor roller 28 and second conveyor roller 30, when combined with the known diameter growth of the log associated with second winding spindle 26, can provide the required contact, clearance, and/or pressure between the conveyor belt 16 and the log associated with second winding spindle 26. However, it should be realized that first conveyor roller 28 and second conveyor roller 30 can have a respective axis A, B in virtually any direction required to provide the required contact or clearance between the conveyor belt 16 and the log associated with second winding spindle 26. Likewise, first conveyor roller 28 and second conveyor roller 30 can have virtually any number of axes (i.e., at least one) associated thereto as required in order to provide the required contact or clearance between the conveyor belt 16 and the log associated with second winding spindle 26.

Optionally, either of the first conveyor roller 28 and the second conveyor roller 30 can be maintained in a fixed position relative to winding spindle 18. In such an embodiment, the other conveyor roller of either of the first conveyor roller 28 and the second conveyor roller 30 would be pivotably, or orbitally, moveable relative to the chosen, fixed conveyor roller. By way of example both of first conveyor roller 28 and second conveyor roller 30 can be fixably mounted to a hinged, flat plate. Such a hinged, flat plate can be provided with a force (such as through a spring, linear actuator, servo motor, cam, link, and the like) at a location distal from a point fixably positioned relative to a winding spindle 18. Such a force applied to the hinged structure could provide for a tighter wind profile for final wound product 14.

If contact between conveyor belt 16 through web material 12 to the log associated with second winding spindle 26 is desired, the position of first conveyor roller 28 and second conveyor roller 30, along exemplary axis A and B respectively, can be controlled to a known position in order to provide the desired contact, or clearance, between the conveyor belt 16 and the log associated with second winding spindle 26 throughout the entire wind, if required. Maintaining the desired contact, or clearance, throughout the entire wind may be particularly advantageous when winding products having higher densities. Maintaining contact throughout the wind, in such an instance is believed to facilitate compaction of all layers of web material 12 within the wound product roll, thereby providing maximum potential density. Maintaining contact throughout the entire wind is also believed to improve product consistency when the web material 12 comprises a structure that is affected by contact force against the conveyor belt 16. By way of example, embossed areas disposed upon web material 12 may have a different appearance or thickness in a region contacted by the conveyor belt 16 compared to an area of conveyor belt 16 not so contacted.

Alternatively, the position of first conveyor roller 28 and second conveyor roller 30 can be positioned along axis A and B respectively in order to regulate the contact force between the conveyor belt 16 and the log associated with second winding spindle 26. By way of example, in order to provide a low density product roll design upon final wound product 14, there may be minimal, or even no, contact between the conveyor belt 16 and the log associated with second winding spindle 26. For medium density product roll designs in final wound product 14, there may be moderate contact, or force, between the conveyor belt 16 and the log associated with second winding spindle 26. For providing high density product roll designs in final wound product 14, there may be relatively high contact, or force, between the conveyor belt 16 and the log associated with second winding spindle 26. In any regard, it is preferred that the rotational speed of the winding spindles 18 be controlled in order to decelerate at a rate that maintains the same winding surface speed, or desired speed differential, as the diameter of the log associated with second winding spindle 26 increases.

As shown in FIG. 1, the hybrid winder preferably provides a turret 20 supporting a plurality of winding spindles 18. The winding spindles 18 preferably engage a core (not shown) upon which the web material 12 is wound. The winding spindles 18 are driven in a closed spindle path about the winding turret 20 assembly central axis 22. Each winding spindle 18 extends along a winding spindle 18 axis generally parallel to the winding turret 20 assembly winding turret axis 22, from a first winding spindle 18 end to a second winding spindle 18 end. The winding spindles 18 are preferably supported at their first ends by the winding turret 20 assembly. The winding spindles 18 are preferably releasably supported at their second ends by a mandrel cupping assembly (not shown). The winding turret 20 preferably supports at least three winding spindles 18, more preferably at least six winding spindles 18, and in one embodiment the turret assembly 20 supports ten winding spindles 18. As would be known to one of skill in the art, a winding turret assembly 20 supporting at least 10 winding spindles 18 can have a rotatably driven winding turret 20 assembly which is rotated at a relatively low angular velocity to reduce vibration and inertial loads, while providing increased throughput relative to indexing a winding turret 20 which is intermittently rotated at higher angular velocities. Exemplary winding turret assemblies suitable for use with the present invention are disclosed in U.S. Pat. Nos. 5,690,297 and 5,913,490.

A perforator roll, anvil, or any other non-contact perforation devices known by those of skill in the art (not shown) can be adapted to provide lines of perforations extending along the cross-machine direction of the web material 12. Adjacent lines of perforations are preferably spaced apart at a predetermined distance along the length of the web material 12 to provide individual sheets of web material 12 that are joined together at the perforations. The sheet length of the individual sheets of web material 12 is the distance between adjacent lines of perforations.

Once the desired number of sheets of web material 12 have been wound into a log associated with second winding spindle 26, in accordance with the present invention, a web separator 34 can be moved into position proximate to web material 12 disposed upon conveyor belt 16 in order to provide separation of adjacent sheets of perforated web material 12. The web separator 34 can be provided as a rotary unit sharing apparatus known to those of skill in the art useful for the severance of the web material 12 into individual sheets. In a preferred embodiment, the web separator 34 cooperates with the surface of conveyor belt 16 upon which web material 12 is disposed. In a preferred embodiment, web separator 34 is provided as a continuous speed roll moved intermittently and/or periodically into contact with the web material 12 disposed upon conveyor belt 16. Alternatively, a suitable web separator 34 for the present invention can be provided with a semi-continuous speed roll that is constantly in contact with web material 12 disposed upon conveyor belt 16. Such a semi-continuous speed roll can be provided with momentary periods of acceleration or deceleration. Yet still, the web separator 34 can be a contacting arm provided with a smooth rubber surface and/or pressers, or pads, intended to exert a pressure, through a slight interference, against the surface of the conveyor belt 16. In such an embodiment, the web separator 34 preferably rotates intermittently, in a clockwise direction; however, the web separator 34 may be provided with a pendulum-like oscillatory movement. The pressers or pads disposed upon web separator 34 preferably move along a circular path which has an axis coincident with the axis of rotation of the web separator 34 and almost tangent to (or making a slight interference with) the surface of the conveyor belt 16 comprising hybrid winder 10.

Once the desired number of sheets of web material 12 have been wound into the log associated with second winding spindle 26, the web separator 34 is moved (i.e., pivoted) into a position which facilitates a nip between a roller, a presser, or pad, associated with the web separator 34 and the conveyor belt 16 upon which web material 12 traverses. The movement of the web separator 34 is timed such that the web separator 34 nips the web material 12 against the conveyor belt 16 when the perforation at the trailing end of the last desired sheet for the log associated with second winding spindle 26 is located between the first, or new, winding spindle 24 at the transfer position (i.e., at the web material 12 nip point) and the web separator 34 surface when it contacts the conveyor belt 16.

Additionally, the portion of web separator 34 that forms the nip against the conveyor belt 16 can have a surface speed that is either less than, the same as, or greater than, the surface speed of the conveyor belt 16 and the web material 12 cooperatively associated thereto. In a preferred embodiment, the web separator 34 is provided with a surface speed greater than that of the surface speed of the conveyor belt 16 and the web material 12 cooperatively associated thereto. Without desiring to be bound by theory, it is believed that if the conveyor belt 16 is provided with a low coefficient of friction and the web separator 34 is provided with a surface speed greater than that of conveyor belt 16, the web separator 34 effectively accelerates the web material 12 at the nip point because the web material 12 slips relative to the conveyor belt 16 traveling at the desired web material 12 winding speed. Concurrent with such over-speed nip formation between web separator 34 and conveyor belt 16, a succeeding new winding spindle 18 that will form the log associated with first winding spindle 24, traveling at the same surface speed as the web material 12, nips the web material 12 against the conveyor belt 16. Such a combination of the downstream over-speed nip formation between web separator 34 and conveyor belt 16 and the winding speed upstream nip formation between first winding spindle 24 and conveyor belt 16 causes the perforation disposed upon web material 12 located between the two nip points to break resulting in the formation of a final wound product 14 having the desired number of sheets of web material 12 disposed thereon resulting from the log associated with second winding spindle 26.

Alternatively, the web separator 34 can be provided with a surface speed lower than that of the surface speed of the conveyor belt 16 and the web material 12 cooperatively associated thereto. If the conveyor belt 16 is provided with a low coefficient of friction and the web separator 34 is provided with a surface speed lower than that of conveyor belt 16, the web separator 34 can decelerate the web material 12 at the nip point because the web material 12 slips relative to the conveyor belt 16 traveling at the desired web material 12 winding speed causing the perforation disposed between the web separator 34/conveyor belt 16 and second winding spindle 26/conveyor belt 16 nip points to break resulting in the formation of a final wound product 14 having the desired number of sheets of web material 12 disposed thereon resulting from the log associated with second winding spindle 26. Concurrent with such an under-speed nip formation between web separator 34 and conveyor belt 16, a succeeding new winding spindle 18 that will form the log associated with first winding spindle 24, traveling at the same surface speed as the web material 12, nips the web material 12 against the conveyor belt 16. That portion of web material 12 disposed beyond the nip formed between first winding spindle 24 and conveyor belt 16 can then be recalled and wound upon first winding spindle 24.

In yet still another embodiment, web separator 34 can be surface-speed matched with conveyor belt 16. In such an embodiment, web separator 34 is preferably provided with at least one blade that is inter-digitating and/or nestably related with a corresponding depression(s), groove(s), and/or blade (s), retractable or otherwise, disposed upon conveyor belt 16. It is believed that such inter-digitating and/or nestable blade assemblies known by those of skill in the art can be adapted to provide such a surface speed-matched web separator 34 assembly. By way of non-limiting example, the assemblies discussed in U.S. Pat. Nos. 4,919,351 and 5,335,869 can be adapted to provide such a surface speed-matched web separator 34 assembly suitable for use with the present invention.

The web material 12 disposed upon conveyor belt 16 upstream of the nip formed between web separator 34 and conveyor belt 16 is then transferred to a new winding spindle 18 which has had an adhesive disposed thereon. In a preferred embodiment, a core is disposed upon the new winding spindle 18 that is first winding spindle 24 and is held securely thereto. The winding turret 20 comprising the winding spindles 18 moves the first winding spindle 24 to the finish wind position, either intermittently or continuously, and the winding cycle is repeated. After the wind has been completed, the final wound product 14 is removed from first winding spindle 24 disposed upon turret assembly 20 and a new core is preferably disposed upon the now vacant winding spindle 18. Adhesive can then be applied to the new core prior to the web transfer. The winding sequence is then repeated as required.

As described previously, a preferred embodiment of the present invention includes winding the web material 12 on hollow cores for easier roll mounting and dispensing by the consumer. Additionally, the hybrid winder 10 of the instant invention provides for adjustable sheet length capability in order to provide format flexibility and sheet count control in increments of one for such format flexibility.

Further, the winding spindles 18 can be provided with a speed profile that can allow for enhanced winding capability of hybrid winder 10 as would be done by one of skill in the art. Such enhanced winding capability may be useful or even preferable with low-density substrates. Additionally, disposing conveyor belt 16 upon moveable first roller 28 and second roller 30 can provide for an adjustable contact position and/or force upon winding spindle 18 and web material 12 at the periphery of the log associated with second winding spindle 26. Thus, providing second winding spindle 26 with an adjustable rotational speed provides for the ability to apply a force at the point where web material 12 is disposed upon second winding spindle 26 or any of the winding spindles 18. This process can provide for a final wound product 14 having the desired wind profile.

For example, final wound product 14 may be produced by a web material 12 having a perforated sheet length of 250 mm, a 100 sheet count, a finished roll diameter of 130 mm, and be wound upon a core having an outer diameter of 40 mm. Using this information, the theoretical average radial thickness for each layer of web material 12 comprising final wound product 14 can be calculated to be about 480 μm. In such an exemplary embodiment, the web material 12 may be provided with an initial (i.e., untensioned) thickness of 750 μm as web material 12 enters the winding area of hybrid winder 10. In order to provide for the above-described final wound product 14, if no contact exists between conveyor belt 16 and the log associated with a winding spindle 18, the web material 12 must be compressed from the initial thickness of 750 μm to the required theoretical target thickness of 480 μm by only the tension exerted by the winding spindle 18 speed on the incoming web material 12. Without desiring to be bound by theory, the calculated tension required to decrease the thickness of web material 12 from an initial 750 μm thickness to the required 480 μm thickness is about 500 grams per linear cm. However, one of skill in the art will appreciate that the web material 12 may separate uncontrollably at the perforations disposed within web material 12 when web material 12 is subject to such a tension (i.e., nominally greater than 350 grams per linear cm). Such uncontrolled separations can produce an unacceptable final wound product 14 and potentially result in line/production stoppages.

Additionally, the hybrid winder 10, as disclosed supra, may be utilized to provide supplemental compression of the web material 12 being wound upon a winding spindle 18 to produce final wound product 14. For example, the conveyor belt 16 may be loaded against the log associated with the winding spindle 18 by moving the position of first conveyor roller 28 and second conveyor roller 30 relative to a winding spindle 18 in order to achieve the desired final wound product 14. For example, the conveyor belt 16 may be loaded against a log disposed upon a winding spindle 18 with a force of 100 grams per linear cm. By calculation, it is believed that such a force may decrease the thickness of the web material 12 from a thickness of 750 μm to a thickness of 500 μm. The calculated required winding tension to further decrease the thickness of web material 12 from a thickness of 500 μm to the required thickness of 480 μm may be provided with as little as 40 grams per linear cm. This required tension level is well below the known, and assumed, perforation separation level of 350 grams per linear cm, thereby allowing reliable production of the desired final wound product 14.

Additionally, one of skill in the art will understand that the hybrid winder 10 disclosed herein can provide contact with the log associated with second winding spindle 26 through the entirety of the wind cycle. Thus, a final wound product 14 can be provided with heretofore unrealized wind uniformity throughout the entire final wound product 14. Further, one of skill in the art will realize that providing winding spindles 18 in a turret system 20 moving in a closed path can provide for continuous winding and removal of final wound product 14 without the need to interrupt the turret system 20 to load and unload winding spindles 18 or even the cores disposed upon winding spindles 18 from a moving turret system 20 mechanism.

Process

As used herein, a 'machine degree' is equivalent to 1/360 of a complete cycle. With regard to the hybrid winder 10 described herein, 360 machine degrees is defined as a complete rewind cycle, that is, from a first identified index position (such as an initial transfer position or a final wind position) to the next identical and succeeding index position (such as the second identical initial transfer position or the second identical final wind position).

Figure 2:
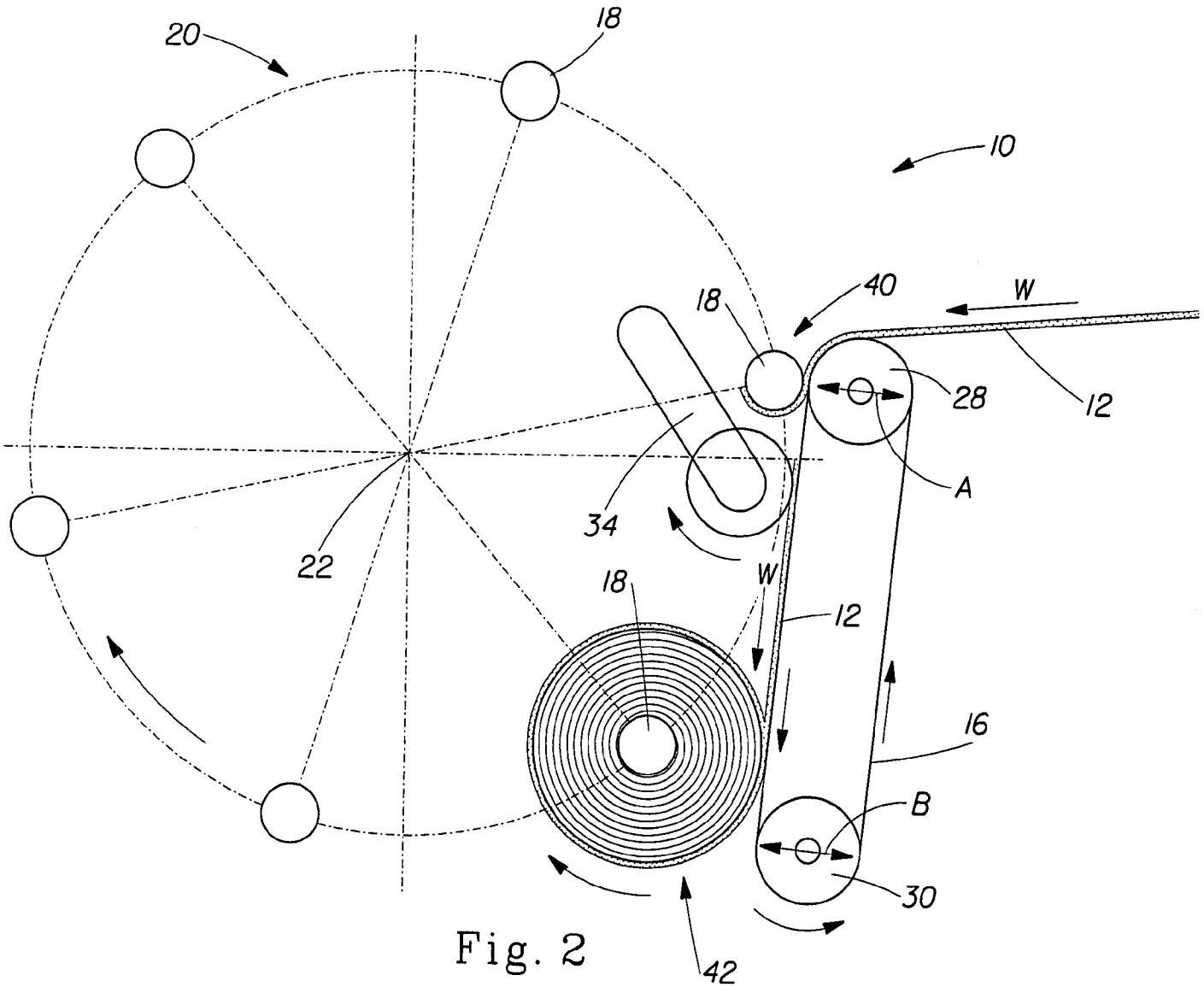
FIG. 2 is a cross-sectional view of an exemplary embodiment of a hybrid winder in accordance with the present invention at about 0 machine degrees.

Referring to FIG. 2, the hybrid winder 10 of the present invention is shown at about 0 machine degrees. The web material 12 disposed upon conveyor belt 16 has been separated at an identified perforation by web separator 34. Web separator 34 provides for a nip, or pinch, of the web material 12 between an outer surface of web separator 34 and conveyor 16 proximate to the identified perforation. Concurrent with the separation of web material 12 at the identified perforation, first conveyor roller 28 supporting conveyor belt 16 is moveable along an exemplary axis A to facilitate compression of the leading edge of web material 12 against winding spindle 18 forming new log 40. In a preferred embodiment, each winding spindle 18 is provided with a core having an adhesive disposed upon the surface thereof to facilitate attachment of the leading edge of web material 12 to the respective winding spindle 18. Further, the remaining web material 12 attached to winding spindle 18 forming old log 42, continues to be disposed thereon. Second conveyor roller 30 supporting conveyor belt 16 is moveable about exemplary axis B in order to provide for a desired pressure to be exerted upon old log 42 having web material 12 disposed thereon by conveyor belt 16. It is in this manner that old log 42 can be provided with a desired wind profile during the entirety of the winding process.

Figure 3:
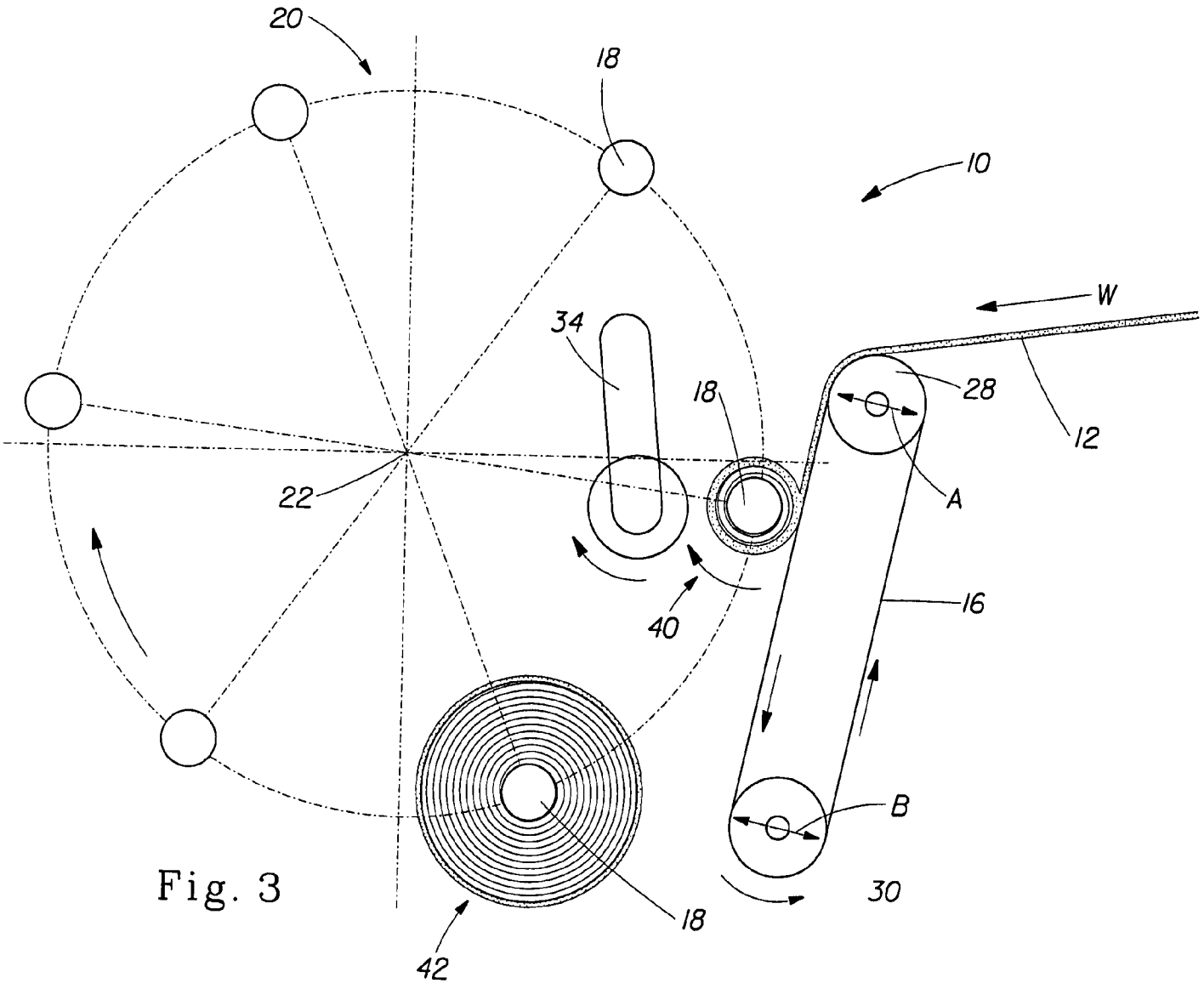
FIG. 3 is the exemplary embodiment shown in FIG. 2 at about 48 machine degrees.

Referring to FIG. 3, the hybrid winder 10 of the present invention is shown at about 48 machine degrees. In this regard, web material 12 is being disposed upon winding spindle 18 to form new log 40, as new log 40 progresses from the first initial contact position to a final log winding position. Concurrent with new log 40 growth upon winding spindle 18, the speed at which winding spindle 18 turns is preferably adjusted to maintain a matched surface speed of new log 40 with incoming web material 12 disposed upon conveyor belt 16. Additionally, axis A of first conveyor roller 28 and axis B of second conveyor roller 30 can be adjusted in order to provide the desired pressure upon new log 40 as the diameter of new log 40 increases radially due to deposition of web material 12 thereupon. Concurrent with the movement of new log 40 toward a final wind position, web separator 34 is positioned away from the region of nip formation between the tip of web separator 34 and conveyor belt 16. Further, old log 42 disposed upon winding spindle 18 is now positioned so that old log 42 can be removed from turret assembly 20 and a new core, if required, can be disposed upon the winding spindle 18 previously occupied by old log 42.

Figure 4:
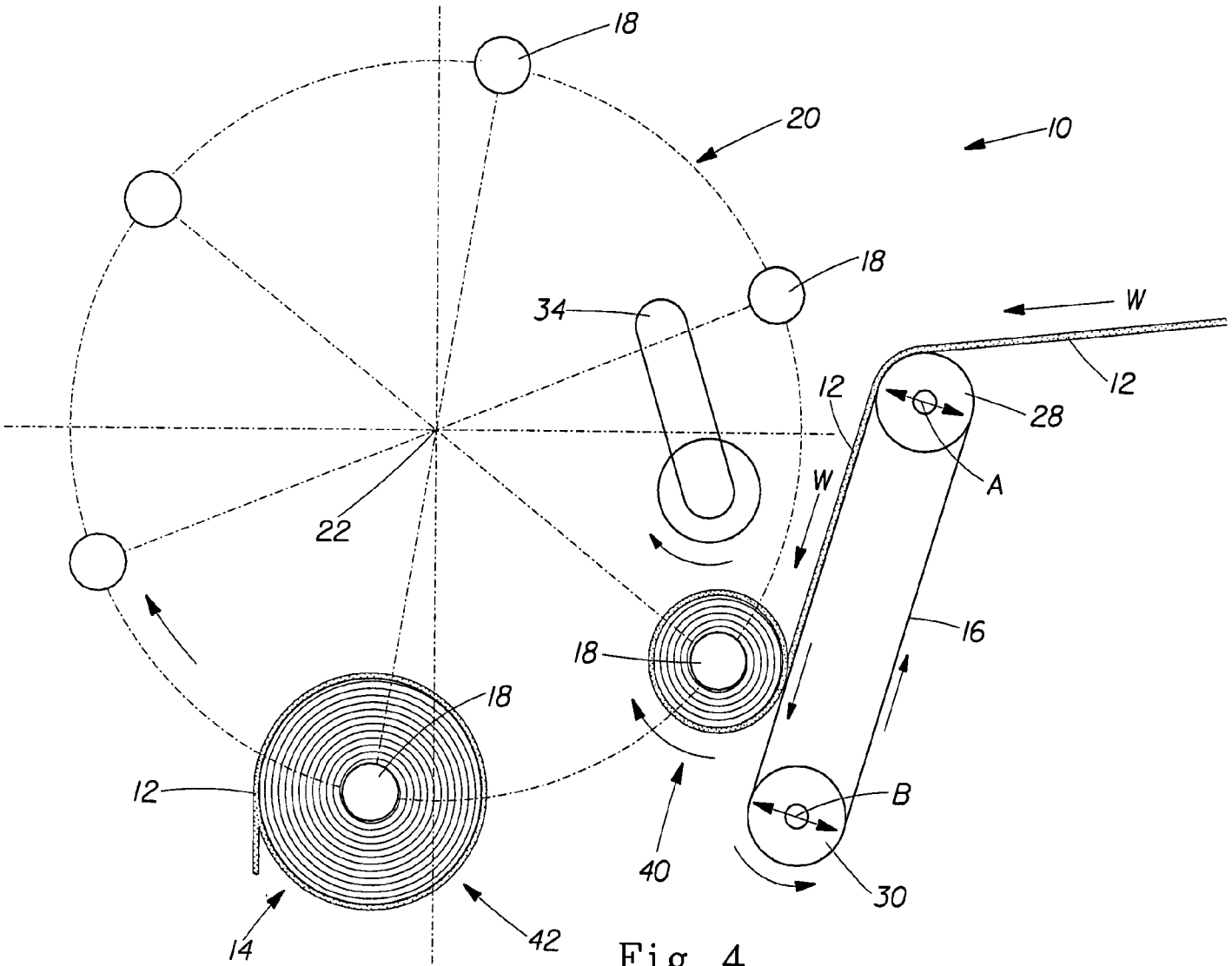
FIG. 4 is the exemplary embodiment shown in FIG. 2 at about 120-336 machine degrees.

FIG. 4 depicts the hybrid winder 10 of the present invention as would be seen from about 120 to about 336 machine degrees. In this position, the new log 40 continues to display radial growth as web material 12 is rotationally disposed thereupon. As new log 40 progresses to a final wind position, a new winding spindle 18 is positioned proximate to the initial loading stage and prepared for reception of web material 12 upon separation by web separator 34. As required, the position of second conveyor roller 30 can be adjusted along axis B, either with or without adjustment of the position of first conveyor roller 28 along axis A, in order to provide the desired surface pressure upon new log 40 in order to provide for the desired winding profile. As new log 40 progresses orbitally about axis 22 of turret assembly 20, old log 42 having web material 12 disposed thereupon can be prepared for removal from turret assembly 20 as final wound product 14.

Figure 5:
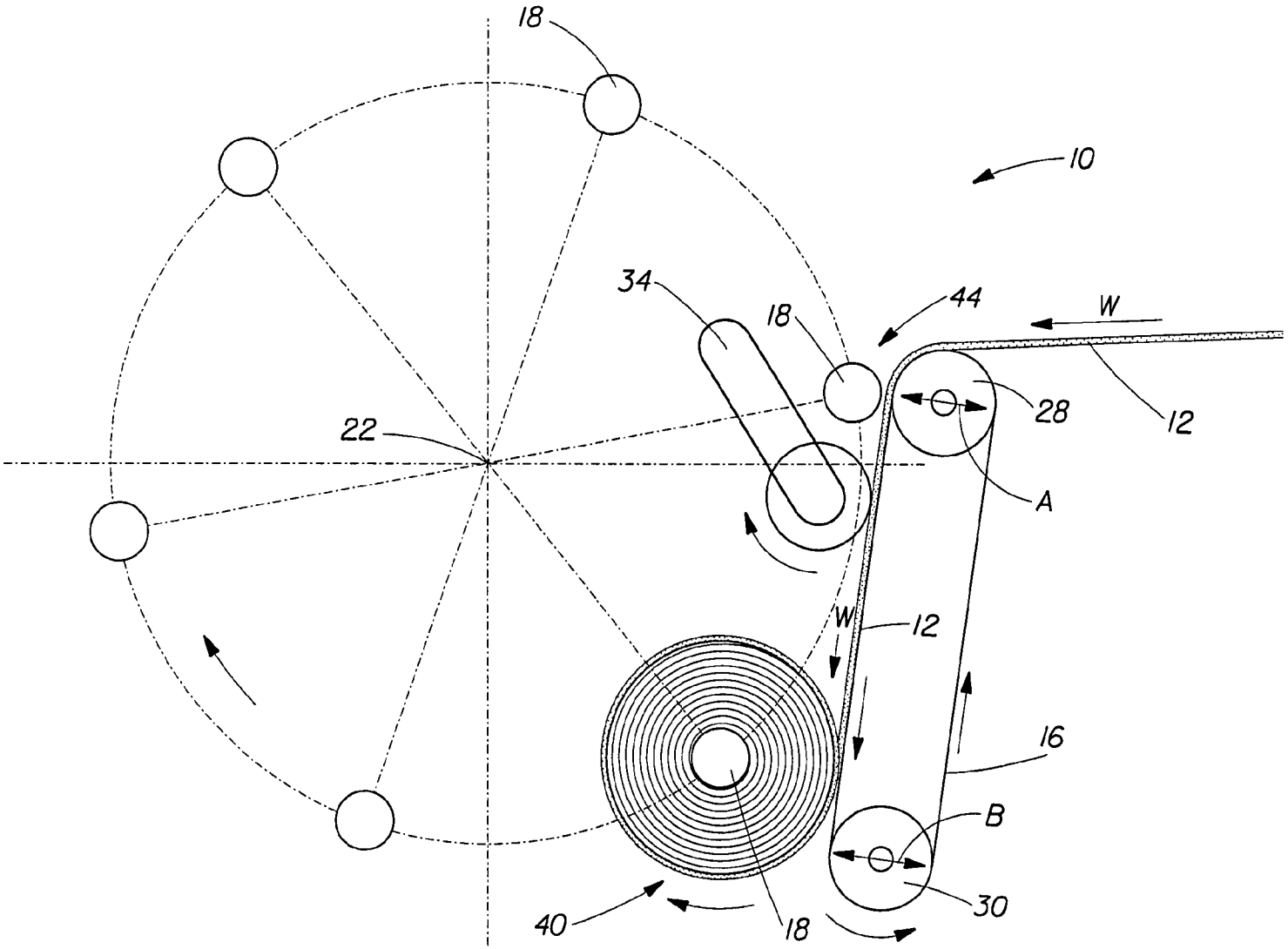
FIG. 5 is the exemplary embodiment as shown in FIG. 2 at about 359 machine degrees.

FIG. 5 depicts the hybrid winder 10 of the present invention at approximately 359 machine degrees. At this point, new log 40 is experiencing radial growth due to the continued deposition of web material 12 thereupon. The position of second conveyor roller 30 is adjusted along axis B in order to provide the required pressure of conveyor belt 16 upon new log 40 in order to provide the desired wind profile as web material 12 is disposed thereon. Concurrently, first conveyor roller 28 is moved along axis A to a position proximate to winding spindle 18 that will form a second new log 44. Further, web separator 34 is moved into a position proximate to conveyor belt 16 in order to facilitate separation of web material 12 at the desired perforation as described supra.

In a preferred embodiment, the desired chop-off perforation disposed upon web material 12 is positioned within ½-inch (1.27 cm), more preferably within ¼-inch (0.64 cm), and most preferably within ⅛-inch (0.32 cm), of the transfer nip (formed between new log 40 and conveyor belt 16) and on the downstream side of the nip formed between new log 40 and conveyor belt 16. It is believed that this can minimize the portion of the sheet of web material 12 that extends beyond the transfer point onto the winding spindle 18 forming second new log 44. It is believed that this can reduce or eliminate the 'fold-back' typically associated with the prior art chop-off/transfer systems. It should be understood that such foldback is typically associated with wrinkles on the core sheet forming final wound product 14 and are generally perceived as lower quality and can prohibit and/or inhibit consumers from using the first sheet disposed upon a core forming final wound product 14. Further, the web separator 34 can be registered with other features of the web material 12. This can include registration with embossing, perforations, other indicia, and the like, in either the machine and/or cross-machine directions. It is believed that this capability can be used to preferentially exert more or less contact force in desired areas of the web material 12 corresponding to other product properties. Such operations can be developed, and are fully intended within the scope of the present invention to avoid contact on a highly embossed area and may eventually preserve target aesthetics.

Alternatively, and as would be known to one of skill in the art, web separator 34 can be provided as a continuous belt configured to contact the web material 12 disposed upon conveyor belt 16 during a portion (i.e., intermittently), or the entirety (i.e., continuously), of the wind cycle. Such a continuous belt could be driven by a plurality of rollers that such a continuous belt is disposed upon. The rollers driving such a continuous belt can be provided with a momentary acceleration or deceleration in order to provide the force necessary to separate the web material 12 at the desired perforation as discussed supra. In an embodiment comprising an intermittently web-contacting conveyor web separator 34, the movement of the web separator 34 is timed such that the web separator 34 nips the web material 12 against the conveyor belt 16 when the perforation at the trailing end of the last desired sheet for the log associated with second winding spindle 26 is located between the first, or new, winding spindle 24 at the transfer position (i.e., at the web material 12 nip point) and the nip formed by the web separator 34 and conveyor belt 16. In either the intermittent or continuous web-contacting conveyor web separator 34 embodiment, combining a downstream, over-speed nip formation between web separator 34 and conveyor belt 16 and the winding speed, upstream nip formation between first winding spindle 24 and conveyor belt 16 can cause the perforation disposed upon web material 12 located between the two nip points to break resulting in the formation of a final wound product 14 having the desired number of sheets of web material 12 disposed thereon resulting from the log associated with second winding spindle 26. The web material 12 disposed upon conveyor belt 16 upstream of the nip formed between web separator 34 and conveyor belt 16 is then transferred to a new winding spindle 18 as described supra. It should be easily recognized by one of skill in the art that in any case, the intermittent or continuous web-contacting conveyor web separator 34 embodiments can be operatively associated with conveyor belt 16 with a surface speed that is either less than, the same as, or greater than, the surface speed of the conveyor belt 16 and the web material 12 cooperatively associated thereto. Modifications commensurate in scope with such embodiments to provide for any of the lower than-, greater than-, or equal to-surface speed embodiments of an intermittent or continuous web-contacting conveyor web separator 34 have been discussed supra.

The position of any driven and/or non-driven rollers in such a system could be controlled independently by linear actuators as would be known to one of skill in the art. Such linear actuators could be controlled to provide the desired contact force and/or distance between the conveyor belt 16 and the continuous belt comprising web separator 34 at any point during the wind cycle. Linear actuators can also be controlled to regulate the final wound product 14 diameter by forcing the web substrate 12 into a desired or required target diameter at all points during the wind cycle.

In yet another embodiment, the web separator 34 can be provided with a permeable surface or any other type of surface that provides for the application of a substance from web separator 34 to the web material 12 either continuously (i.e., web separator 34 is in continuous contact with web material 12) or discontinuously (i.e., web separator 34 is in periodic contact with web material 12). In such an embodiment web separator 34 is preferably in fluid communication with a supply of substance sought to be disposed upon web material 12. Alternatively, such a permeable web separator 34 can be in fluid communication with a source of vacuum that facilitates the withdrawal or removal of moisture or debris from the surface of web material 12. It is believed that one of skill in the art would be able to adapt such a permeable roll to such a vacuum source in order to facilitate such removal of unwanted products, components, constituents, or debris, from the surface of web material 12. Yet still, web separator 34 can be heated and/or cooled, as would be done by one of skill in the art, in order to effectuate the positive benefits by the association of heat and/or cooling to the web material 12 in order to activate or control a desired process either on, or with, web material 12.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A winder for winding a web material into rolls, the winder comprising:

first and second rollers, said first and second rollers each having a longitudinal axis associated thereto, said longitudinal axis of said first roller and said longitudinal axis of said second roller being generally parallel;

a continuous belt having a machine direction, a cross-machine direction coplanar and orthogonal thereto, and a Z-direction orthogonal to both said machine direction and said cross-machine direction, said continuous belt being disposed about said first and second rollers, said web material being disposed upon at least a portion of said continuous belt;

a winding spindle provided with an adjustable rotational speed profile arranged to be rotatably driven about an axis generally parallel to said longitudinal axes of said first and second rollers, said winding spindle being adapted to receive said web material when said spindle is proximate said web material disposed upon said continuous belt; and, wherein at least one of said longitudinal axis of said first roller and said longitudinal axis of said second roller is adjustable relative to said winding spindle to provide a compressive force to the surface of said winding spindle.

2. The winder according to claim 1 wherein said winding spindle is operatively mounted upon a winding turret.

3. The winder according to claim 2 wherein said winding turret comprises a plurality of winding spindles.

4. The winder according to claim 2 wherein said winding turret is indexable about a winding turret axis through an endless series of indexed positions.

5. The winder of claim 1 wherein said winding spindle further comprises a core disposed thereon, said web material being received by said core when said winding spindle is proximate said web material disposed upon said continuous belt.

6. The winder of claim 1 wherein said first and second rollers are moved by a linear actuator.

7. The winder of claim 1 wherein said continuous belt has a roller contacting surface and an outer surface opposed thereto, and wherein said web material comprises a continuous belt contacting surface, and wherein said outer surface of said continuous belt and said belt contacting surface of said web material are substantially speed matched.

8. The winder of claim 1 wherein said winding spindle has a winding speed, said winding speed of said winding spindle being adjustable.

9. The winder of claim 1 further comprising a perforation assembly, said perforation assembly being capable of providing a plurality of cross-machine direction perforations in said web material prior to said web material contacting said continuous belt.

10. The winder of claim 1 further comprising a web separator having a peripheral speed and being adapted to periodically pinch said web material between said web separator and said continuous belt when the peripheral speed of said web separator and the speed at which said web material is moving are different.

11. The winder of claim 10 wherein said web separator is constructed and arranged to move at a peripheral speed faster than a speed of said web material.

12. The winder of claim 11 wherein said continuous belt has a web material contacting surface, said web material contacting surface having a low coefficient of friction.

13. The winder of claim 10 wherein said periodic pinch of said web material occurs between said winding spindle receiving said web material and a second winding spindle being adapted to receive said web material.

14. The winder of claim 1 wherein said adjustment of at least one of said longitudinal axis of said first roller and said longitudinal axis of said second roller causes said continuous belt to be moveable in at least said Z-direction.

15. The winder of claim 14 wherein said Z-direction movement of said continuous belt is capable of changing a pressure exerted by said continuous belt upon said web material when said web material is disposed between said continuous belt and said winding spindle.

16. A winder for winding a web material into rolls, the winder comprising:

a belt having a machine direction, a cross-machine direction coplanar and orthogonal thereto, and a Z-direction orthogonal to both said machine direction and said cross-machine direction, said web material being disposed upon at least a portion of said belt;

a winding spindle arranged to be rotatably driven about an axis generally parallel to said cross-machine direction of said belt, said winding spindle being provided with an adjustable rotational speed profile, said winding spindle being adapted to receive said web material when said spindle is proximate said web material disposed upon said belt, said belt providing a compressive force to the surface of said winding spindle; and, a web separator having a peripheral speed, said web separator being adapted to periodically pinch said web material between said web separator and said belt when said peripheral speed of said web separator and the speed at which said web material is moving are different.

17. The winder of claim 16 wherein said web separator is constructed and arranged to move at a peripheral speed faster than the speed of said web material.

18. The winder of claim 16 wherein said belt is provided with a relieved surface.

19. The winder of claim 16 wherein said winding spindle is operatively mounted upon a winding turret, said winding turret being indexable about a winding turret axis through an endless series of indexed positions.

20. A winder for winding a web material into rolls, the winder comprising:

a belt having a machine direction, a cross-machine direction coplanar and orthogonal thereto, and a Z-direction orthogonal to both said machine direction and said cross-machine direction, said web material being disposed upon at least a portion of said belt;

a winding spindle operatively mounted upon a winding turret indexable about a winding turret axis through an endless series of indexed positions, said winding spindle being provided with an adjustable rotational speed profile and arranged to be rotatably driven about an axis generally parallel to said cross-machine direction of said belt, said winding spindle being adapted to receive said web material when said winding turret is indexed between a first index position and a second index position, said spindle being proximate said web material disposed upon said belt between said first and second index positions, said belt providing a compressive force to the surface of said winding spindle; and, a web separator having a peripheral speed, said web separator being adapted to periodically pinch said web material between said web separator and said belt when said peripheral speed of said web separator and the speed at which said web material is moving are different.

* * * * *